United States Patent [19]

Owensby et al.

[11] Patent Number: 4,729,209

[45] Date of Patent: Mar. 8, 1988

[54] APPARATUS AND METHOD FOR INSERTING POUCHES INTO BOXES

[75] Inventors: Joseph E. Owensby, Spartanburg; Fred A. Dobbins, Lyman, both of S.C.

[73] Assignee: W. R. Grace & Co., Cryovac Div., Duncan, S.C.

[21] Appl. No.: 919,743

[22] Filed: Oct. 16, 1986

[51] Int. Cl.[4] ..... B65B 43/18; B31B 7/02

[52] U.S. Cl. ..... 53/434; 53/449; 53/175; 53/573; 493/100

[58] Field of Search ..... 53/175, 449, 434, 573; 493/100, 101

[56] References Cited

U.S. PATENT DOCUMENTS

| | | | |
|---|---|---|---|
| 3,380,222 | 4/1968 | Bergmann et al. | 53/175 X |
| 3,619,981 | 11/1971 | Burke et al. | 53/573 |
| 4,083,293 | 4/1978 | Goldstein | 53/175 X |
| 4,089,255 | 5/1978 | Akoh et al. | 53/175 X |
| 4,142,453 | 3/1979 | Gidewall et al. | 53/175 X |
| 4,320,615 | 3/1982 | Gmur | 53/573 X |
| 4,345,629 | 8/1982 | Inglett, Jr. | 53/573 X |
| 4,522,012 | 6/1985 | Nelson | 53/175 |

*Primary Examiner*—James F. Coan

*Attorney, Agent, or Firm*—John J. Toney; William D. Lee, Jr.; Mark B. Quatt

[57] ABSTRACT

An apparatus and method for inserting pouches into boxes or lining boxes with pouches is disclosed. Rather than manually line boxes, the apparatus takes a pouch from a horizontal stack of pouches, opens the pouch over an open box, partially inflates the pouch, and, inserts the pouch into the box. A vertically reciprocating mandrel is included with tucker fingers to fold the bag's mouth over the outside perimeter of the box thus presenting a line box ready to receive a product.

6 Claims, 8 Drawing Figures

APPARATUS AND METHOD FOR INSERTING POUCHES INTO BOXES

FIELD OF THE INVENTION

This invention relates to an apparatus and method for inserting a flexible container such as a pouch or bag into a rigid container such as a paperboard box. Specifically, the invention provides a method and apparatus to line a box with a plastic pouch so that product can be placed into the pouch which is subsequently evacuated, possibly back flushed with inert gas, and hermetically sealed.

BACKGROUND OF INVENTION

Paperboard or cardboard boxes lined with plastic material such as polyethylene or other plastics are well-known and have been widely used for many years for packaging a great variety of products including fresh beef, pork, veal, lamb, cheese and other perishable food products. The plastic liners which may be in the form of pouches or bags may be manually inserted into the rigid box or container and then filled with the desired product. However, there are known devices wherein a plastic bag or pouch is placed on a mandrel which then moves into a box to insert the bag into the box. Since it is necessary to insure that the mouth of the bag or liner is open so that it does not interfere with the filling of the pouch after it is inserted into the box, the pouch mouth is manually folded around the outer perimeter of the upper part of the box.

Folding the open end of the bag around the open upper perimeter of the end of the box manually slows production time in a packaging plant. This is particularly true where the box is large and the liner or pouch cannot be conveniently handled by one person. Accordingly, it is one object of the present invention to provide an apparatus which can handle and insert pouches into bags which normally would not be handled by one person alone.

One representative prior art device is disclosed in U.S. Pat. No. 3,619,981 which issued on Nov. 16, 1971 to H. A. Burke et al. In the Burke et al patent pouches are moved from stack of flattened pouches along a curvilinear path to a vertical position to be loaded from a chute. Accordingly, another object of the present invention is to provide a method and apparatus for moving a pouch from a lay flat horizontal position to a vertical position and open it by a simplified path of motion.

In another prior art disclosure, namely, U.S. Pat. No. 4,083,293 which issued on Apr. 11, 1978 to Ralph S. Goldstein, a pouch inserting means including a pair of cross heads movable with respect to each other is employed. In U.S. Pat. No. 4,522,012 which issued to Rodney C. Nelson on June 11, 1985 a bag inserter machine is disclosed where the leading bag is joined to a bag roll along a perforated line and the leading bag is dispensed from the bag roll. Accordingly, another object of the present invention is to provide a method and apparatus which are an improvement over the apparatus and method disclosed in the aforementioned patents.

Yet another prior art device is disclosed in U.S. Pat. No. 4,142,453 which issued on Mar. 6, 1979 to Kenneth L. Gidewall. The Gidewall patent discloses an apparatus for inserting a flexible container into a substantially rigid outer container wherein an operator must place a bag on a mandrel which is held there by outwardly movable folder plates. Accordingly, it is another object of the present invention to eliminate as many steps as possible from the process of inserting a bag into a box which have to be performed manually.

The foregoing and other objects of the present invention will become apparent to those skilled in the art from the following summary of the invention, description of the drawings, and detailed description.

SUMMARY OF THE INVENTION

In one aspect, the present invention is an apparatus for inserting pouches into boxes comprising transfer means for holding a flattened pouch in a vertical position; gripping means for opening the flattened pouch and holding the pouch open; means for positioning a box beneath the opened pouch; mandrel means for removing the pouch from the gripping means and inserting the pouch inside the box; and, tucker finger means associated with the mandrel means for folding a portion of the mouth of the bag down and around a portion of the outside of the box.

In another aspect, the present invention is a method for inserting pouches into boxes comprising the steps of removing a pouch from the top most position of a stack of lay flat pouches and positioning the pouch vertically with its mouth opened upwardly; pneumatically holding and opening the pouch while it is in the vertical position; placing a box below the opened pouch; removing the pouch from its vertically held position; partially inflating the pouch; inserting the partially inflated pouch into the box and folding the mouth of the pouch around the open outer perimeter of the box. The method includes the steps of filling the pouch while it is within the box and subsequently evacuating and hermetically sealing the pouch.

DESCRIPTION OF THE DRAWINGS

Appended hereto and made a part of this disclosure are the drawings in which.

DETAILED DESCRIPTION

The apparatus and its working parts will first be described principally with reference to FIGS. 1 and 2 and then the method of operation will be described with reference to FIGS. 3–8.

Figure 1:
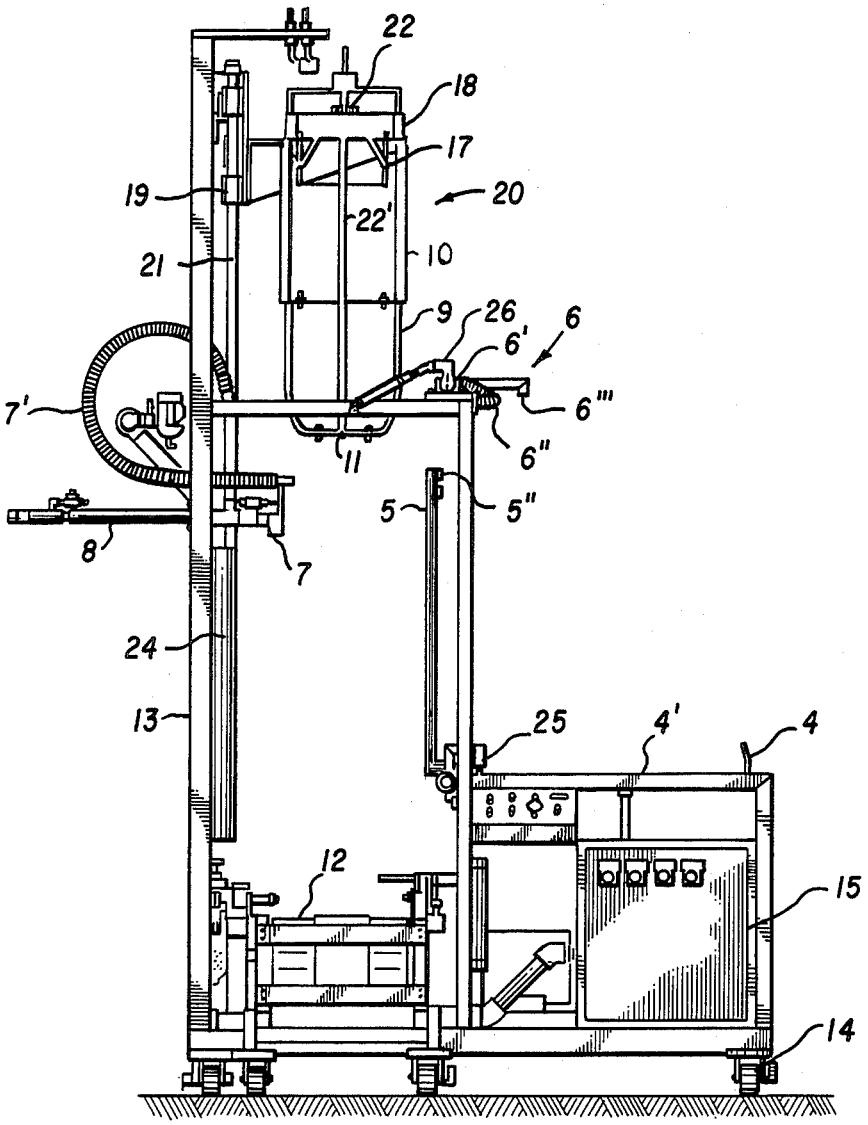
FIG. 1 is an elevation view from the rear of the apparatus according to the invention looking in the direction in which boxes travel on the conveyor.

Looking now at FIG. 1 main frame 13 is shown which includes vertical and horizontal members. A pouch supply means 4' which includes a bed upon which lay flat pouches are arranged and held by a wicket pin 4 is attached to the right hand side of the frame as viewed in FIG. 1. As reference is made herein to pouches, liners, or bags it is understood that all of these refer to flexible containers which can be used to line a box. Generally, these containers or pouches are rectangular in shape so that the mouth of the pouch does not have associated with it any neck which would diminish the area of opening of the mouth.

Figure 2:
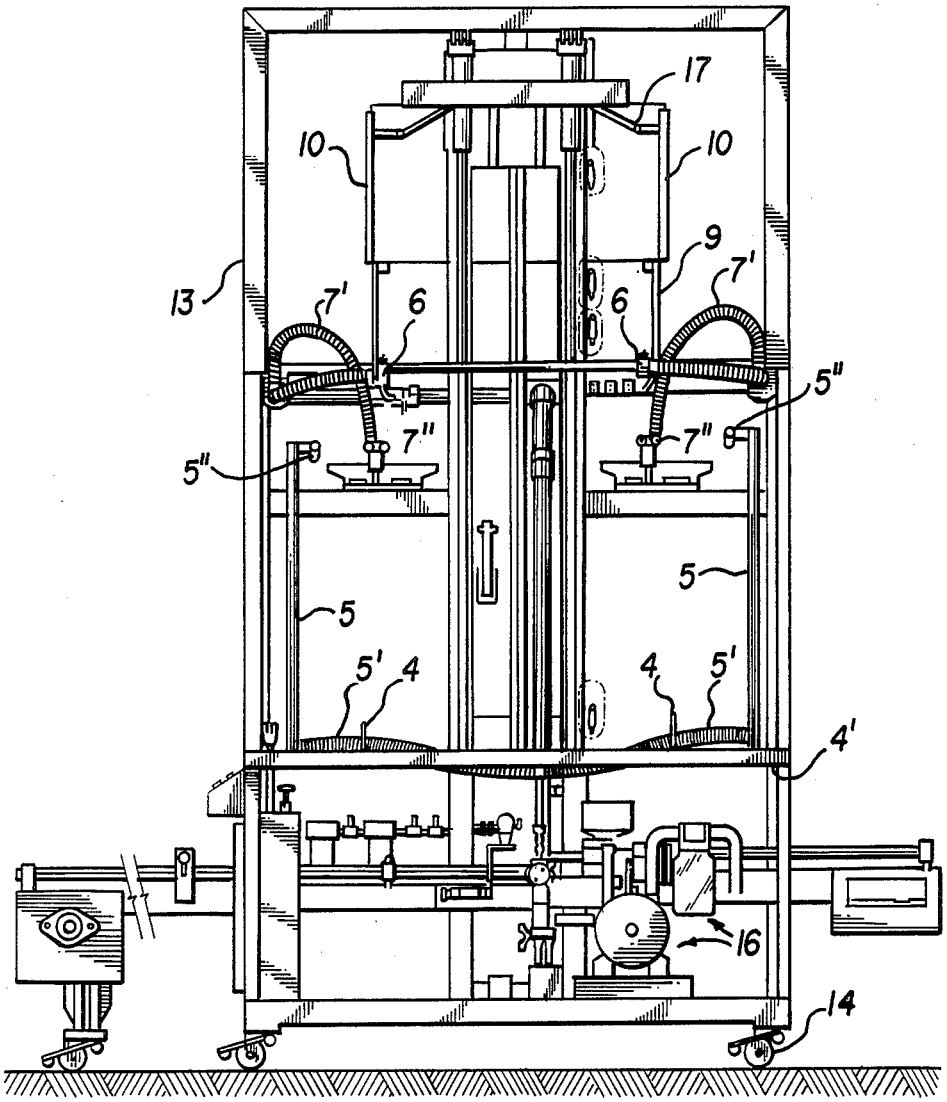
FIG. 2 is a side view looking from the right hand side of FIG. 1.

Still referring to FIGS. 1 and 2, on the right hand side of the frame at about the same level as the pouch supply means 4', is a pivot for transfer arm 5 so that the transfer arm can rotate from its vertical position as shown in FIG. 1 and the suction means, which are suction cups 5", can pick up the uppermost bag in the stack of bags in the pouch supply means. The transfer arm is preferaably hollow so it will serve as a conduit for the vacuum or suction and this conduit is connected to hoses 5' which in turn are connected to the vacuum pump apparatus generally designated as 16 in FIG. 2. Thus, the suction means is associated with the distal end of transfer arm 5 and the pivot is at its proximal end. The suction means performs the function of gripping the upper pouch. The pouch is gripped near the top of the pouch adjacent the mouth and somewhat inboard of the sides of the pouch so that gripping arm 6 may grip the pouch inwardly of the pair of transfer arms so that when the transfer arms move back to a horizontal position when the vacuum to suction cups 5" is released it may simply bend the side of the bag or pouch somewhat as it moves forward to return to its horizontal position in the pouch supply means.

Gripping arm 6 has associated with it a gripping means or vacuum cup at its distal end and it is pivotally mounted at 6' so that the suction means or cups 6''' associated with its distal end can be fed by vacuum hoses 6" which are connected to the vacuum pumps 16.

Means 25 and 26 are for rotating the transfer arm 5 and gripping arm 6 respectively and may be pneumatically driven motors or electrical motors with the appropriate limit swiitches for rotating the arms from their horizontal positions to their vertical positions upon command or signal.

On the side of the frame 13 opposite the gripping arm 6 is mounted an opening arm 7 which has associated with it vacuum hoses 7' to supply suction to the gripping means or suction cups 7" at its forward end. The arm 7 is mounted for horizontal reciprocating motion and is powered by pneumatic cylinder 8. The extreme right hand position of the stroke of the arm 7 will coincide with the vertical position of gripping arm 6 so that gripping arm 6 will hold one side of the bag in a vertical position with the arm 7 holding the other side of the bag. When arm 7 is retracted to its extreme left hand portion of the stroke it will open the bag or pouch which is held by it and the gripping means.

The suction means 6''' and 7" perform the function of gripping the upper pouch. The pouch is gripped near its top adjacent its mouth and somewhat inboard of the sides of the pouch so that gripping arm 6 may grip the pouch inwardly of the transfer arms and when the transfer arm moves back to its horizontal position and the vacuum supplied to cups 5" is released, transfer arm 5 may simply bend the bag or pouch somewhat as it moves forward to return to its horizontal position in the pouch supply means.

Conveyor 12 serves as a means to position an open box or paperboard carton with its top flaps vertical and unfolded beneath the point at which the gripping arm 6 and opening arm 7 hold a vertically positioned bag. The conveyor is provided with means which drive it upon command such as an electrical motor and signal means such as a photo-cell (not shown) are provided so that when the leading edge of the boxes is in the appropriate position the conveyor immediately stops.

A mandrel designated by the numeral 20 is located above the point at which the bag mouth is positioned in its open configuration and mandrel 20 comprises inner mandrel 9 and outer mandrel 10 which is provided with downwardly depending fingers which act as spreader means and means to hold the upper portion of the bag. These fingers are carried on the mandrel 18 and the spreading function is activated by mechanism 17. Mechanism 17 is a conventional lever and linkage means which is powered by pneumatic cylinders, not shown, carried on the upper mandrel frame 18.

An air jet 11 is associated with lower mandrel or inner mandrel 9 so that a blast or jet of air can issue downwardly from the central bottom of mandrel 9 and partially inflate a bag into which mandrel 9 has been partially inserted.

The entire mandrel 20 comprising inner mandrel 9 and upper or outer mandrel 18 is mounted for reciprocal vertical motion up and down mandrel track 21 and mandrel mounting collar 19 supports the mandrel on the track. Mandrel cylinder 24 through connecting rods moves the mandrel 20 upwardly and downwardly on the track.

Other items associated with the apparatus are the support rollers 14 and the main control panel 15. The main control panel allows the timing to be set to sequence events properly and to monitor vacuum pressures, current, voltage and the like as required depending upon which basic control system is adopted. There are two basic control systems which can be used with the apparatus of the present invention both of which are within the scope of those skilled in this art. One system is a pneumatic system coupled with electronic switches and timers where as each event is completed a switch which controls a pneumatic valve is either closed or opened to start the next step in the sequence after timed delay if required. The other system is to have a microprocessor as the control unit and the microprocessor sends a signal to a control switch at each pneumatic cylinder or motor, as the case may be, and turns the particular motor on and then off or activates and deactivates the appropriate pneumatic cylinder in sequence. The necessary delays between signals can be set. Providing pneumatic lines, wiring and the like are well within the skills of those experienced in this art.

Next, to explain the method of the present invention and also the mode of operation of the preferred apparatus reference needs to be made now to FIGS. 3–8. The sequence begins with box 1 arriving on conveyor 12 at a position directly under inner mandrel 9. As stated above, the box 1 is stopped in this position by a signal sent from a photo-cell placed on the main frame 13, but the photo cell is not seen. The positioning will, of course, vary with the size of box so that it may be precisely located beneath the inner mandrel 9.

Figure 8:
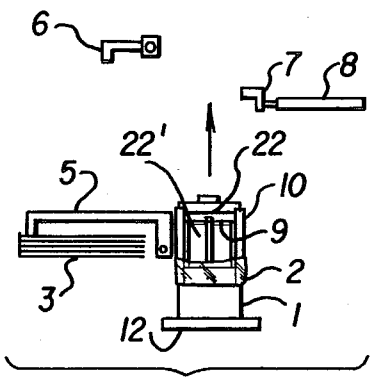
Figure 7:
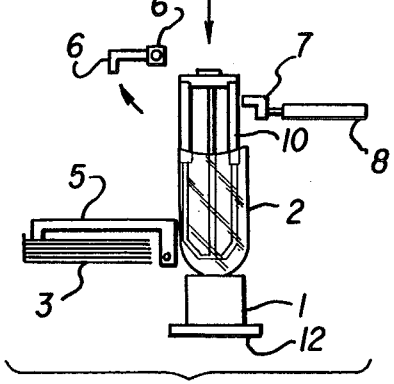

When the box 1 is in position on conveyor 12, the sequence of events begin and transfer arm 5 which has been in a horizontal position (as shown in FIG. 8) is actuated and means 25 rotates the arm 5 upwardly into a vertical position carrying a flattened pouch 2 which is the uppermost pouch in the stack of wicketed pouches 3 which is held by wicket pin 4. This is the sequence which is shown in FIG. 3.

A preferred pouch is one which is made from thermoplastic film material which has a gas barrier layer comprising a vinylidene chloride copolymer or an ethylene vinyl alcohol copolymer with polyolefin layers on either side. Pouches of a size to line relatively large cartons will probably be side seal bags where at the bottom of the bag is the fold in the film and the sides are sealed together leaving the mouth open. Wicket holes are spaced symmetrically and usually only two wicket holes are needed, one near each upper corner of the flattened pouch. It has been found to be most satisfactory to have a stack of these pouches or bags on a wicket in lay flat condition as shown.

Figure 5:
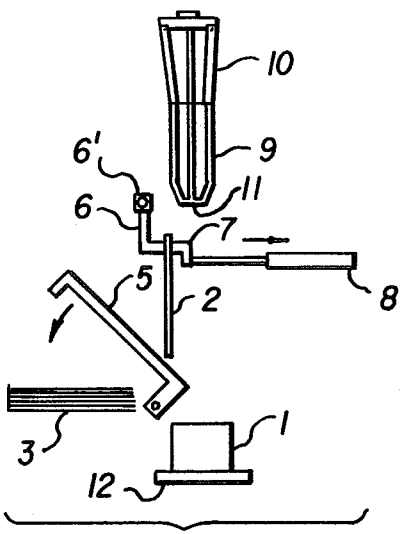
FIGS. 3–8 show in schematic detail the steps of moving and holding a flattened pouch vertically, opening the pouch, removing the pouch from its held position and inserting the pouch into an opened box and folding the mouth of the pouch around the outer perimeter of the upper part of the box.
Figure 4:
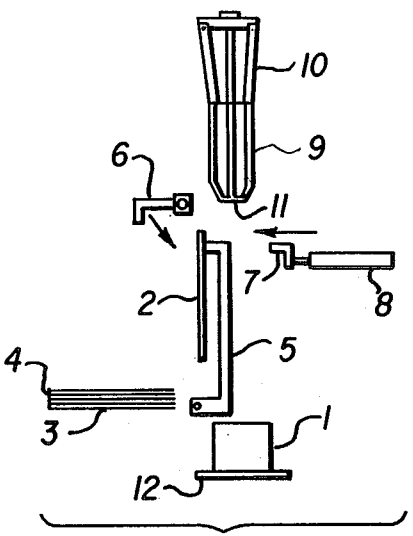
Figure 3:
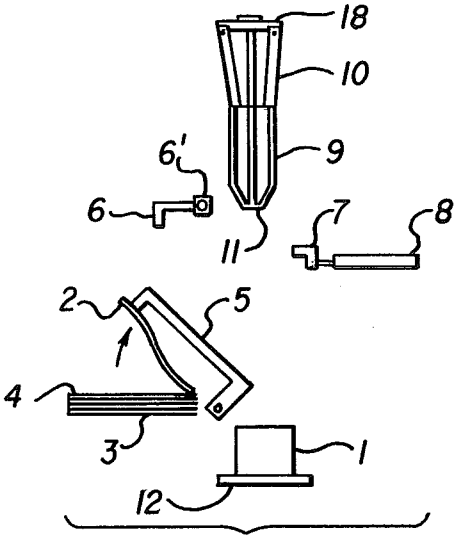

Still looking at FIG. 3, when the transfer arm 5 is rotated, immediately before the rotation begins the suction cups are activated so that the arm will pick up the bag 2. As transfer arm 5 moves to its vertical position as shown in FIG. 4, a signal is sent to gripping arm 6 and opening arm 7. Gripping arm 6 is rotated by rotating means 26 which rotates gripping arm 6 to the position shown in FIG. 5 and simultaneously the suction is activated in the suction cups located on the distal end of gripping arm 6 and pneumatic cylinder 8 activates opening arm 7 and reciprocates the cylinder to drive the transfer arm 7 to the position shown in FIG. 5. At the same time, the suction means on the distal end of the opening arm 7 has been activated so that when it arrives at the position shown in FIG. 5, it can securely grip the bag 2 from the side opposite to which the means 6 is attached. At this point, transfer arm 5 is rotated to its original position. The transfer arm 5 preferably comprises the two sections as can be seen in FIG. 5 and both of these are outboard of the suction cups on gripping arm 6 and opening arm 7 so that when the vacuum to suction cups 5' on transfer arm 5 is shut off, arm means 5 may rotate downwardly clear of the other arms and fold back the two sides of the flexible bag as it passes on its way to the stack of bags 3 as shown in FIG. 6.

Figure 6:
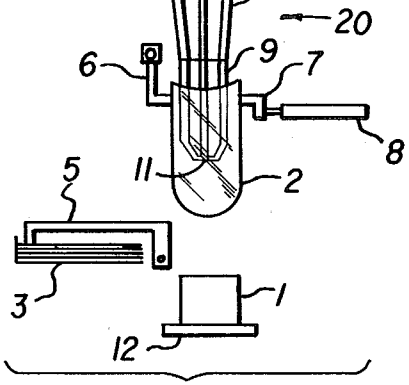

In FIG. 6, the gripping means 6 has stayed in its vertical position to hold its side of the pouch while transfer arm 7 has retracted to its right hand position thus opening the pouch as the suction cups on the distal end of opening arm 7 continue to securely hold to the pouch 2 on the same side which had been previously gripped by the transfer arm 5. While the opening arm 7 has moved to this position, the mandrel 20 which comprises upper mandrel 18 carrying inner mandrel 9 is lowered so that inner mandrel 9 is partially inserted into the now open bag. When the mandrel has descended to this position an air blast is initiated through jet 11 and the bag 2 is partially inflated. The air stream can continue to keep the bag in a deflated position so that wrinkles and folds do not occur as the bag is inserted to line box 1.

As the mandrel further descends, the means for spreading the fingers through linkage 17 (FIG. 2) is actuated so that the spreader fingers move outwardly once they have been inserted into the bag and the fingers grip and spread out the mouth of the bag. At this point gripping arm 6 has been rotated back to its horizontal position and opening arm 7 is retracted.

Continuing to FIG. 8, the mandrel now has descended completely to the bottom of its stroke and the inner mandrel 2 carrying pouch 2 has stopped at the bottom of the box 1 thus stretching and spreading the bottom of the pouch around the bottom of the box. As this is taking place, the upper mandrel 10 which is spring loaded at collar 22 to base support shaft 22, continues downwardly with the spreader fingers which are positioned outwardly of the upper perimeter of the bag and their downward motion carries the bag lip or upper mouth portion downwardly around the upper side of the box and folds the pouch lips around the top of the box to form a "cuff" around the outer perimeter of the box. As the mandrel is then retracted as the cylinder 24 is withdrawn, a lined box ready to receive product is now presented. As the box moves away, it can be loaded preferably with a meat or cheese product, after which it is either evacuated or gas flushed and sealed by heat seal or clip or other means and then the box is closed.

The invention as described above may be embodied in other specific forms without departing from the spirit or essential characteristics thereof. The present embodiment as described is therefore to be considered in all repects is illustrative and not restrictive, the scope of the invention being indicated by the claims which follow rather than by the foregoing description and all changes which come within the meaning and range of equivalency of the claims are therefore intended to be embodied therein.

I claim:

1. Apparatus for inserting pouches into boxes comprising:

(a) pouch supply means for supplying pouches in a flattened horizontal position; said pouch supply means comprising a stack of flattened pouches held by a wicket pin;

(b) pivotally mounted transfer arm means for transferring a pouch from the supply means to a vertical position;

(c) gripping and opening means for removing the pouch from the transfer means and opening the pouch and holding the pouch in a vertical position; said gripping and opening means comprises two suction means for gripping each side of the pouch, one means being movable away from the other to open the pouch;

(d) box conveyor means for positioning an open box beneath the open pouch;

(e) inner mandrel means for removing the open pouch from the gripping means, said mandrel being located above the open pouch, said mandrel means being mounted for vertical reciprocal motion from a position above the open pouch to a position within said box;

(f) air blast means for fully opening said pouch as it is inserted into said box, said air blast means being associated with said inner mandrel;

(g) tucker fingers means for holding the bag as it is removed from the gripping means and for folding a portion of the bag mouth down and around a portion of the outside of the box; said finger means being located above the mandrel and disposed for vertical reciprocal motion therewith, and said tucker finger means being positioned to be partially inserted into the pouch mouth as the inner mandrel moves into the pouch and wherein the finger means include multiple fingers and means for spreading the fingers apart to hold the pouch open.

2. Apparatus for inserting pouches into boxes comprising;

(a) a main frame including vertical and horizontal members;

(b) a pouch supply means for supplying pouches in a horizontal lay flat position, said supply means being attached to one side of said frame;

(c) a transfer arm pivotally mounted at its proximal end on the frame adjacent the pouch supply means, said transfer arm including suction means associated with its distal end whereby when rotated to an approximately horizontal position the suction means will grip the upper pouch, which is lying in the pouch supply means, on one side of the pouch adjacent the pouch's mouth;

(d) means for pivoting the transfer arm from a horizontal position to a vertical position and back again;

(e) a gripping arm mounted on said frame above and on the same side of the frame as the transfer arm, said gripping arm having suction means associated with its distal end and being pivotally mounted at its proximal end whereby said gripping arm can be rotated from a horizontal position to a vertical position to grip the other side of the pouch held vertically by the transfer arm and to hold the pouch;

(f) an opening arm mounted on the side of the frame opposite the gripping arm, said opening arm having suction means associated therewith and being mounted with means for reciprocal horizontal motion to pneumatically hold the same side of the pouch as the transfer arm at the extended end of its stroke thereby allowing the transfer arm to be rotated to its original horizontal position and subsequently opening the pouch when returning to its retracted portion;

(g) means for positioning an open box beneath said opened box;

(h) a mandrel comprising a lower, inner, mandrel and an outer, upper mandrel with vertically disposed fingers mounted thereon, said mandrel being carried by said frame so that the mandrel can vertically reciprocate from an upper position where the inner mandrel is above the opened pouch to a lower position where the inner mandrel is inside the box and the bottom of the inner mandrel is near the inside bottom of the box;

(i) spreader means associated with said mandrel for spreading said fingers after the inner mandrel and lower portion of said fingers have entered the pouch on the mandrel's descent whereby the pouch will be held open by the spread fingers;

(j) an air jet positioned on a lower surface of the inner mandrel whereby once the inner fingers hold the pouch air discharged from the jet will inflate and further open the pouch; and (k) means for continuing the downward motion of the upper mandrel once the lower mandrel has completed its downward stroke thereby allowing said fingers to fold the mouth portion of the pouch down the outside of the box.

3. The apparatus of claim 2 wherein said pouch supply means includes a pair of wicket pins for holding and aligning flattened pouches provided with wicket holes adjacent their mouths.

4. The apparatus of claim 2 wherein the means for positioning an open box beneath the open pouch includes a driven conveyor.

5. A method for inserting pouches into boxes comprising the steps of:

(a) removing a pouch from the topmost position of a stack of layflat pouches and positioning said pouch vertically with its mouth upward;

(b) pneumatically holding and opening said pouch in its vertical position;

(c) placing a box below said opened pouch;

(d) removing said pouch from its vertically held position by providing spreader fingers and using said spreader fingers to remove the pouch from its vertically held position and to fold the pouch mouth around the other perimeter of the box.

6. The process of claim 5 including the steps of filling the pouch within the box with product and subsequently evacuating and hermetically sealing the pouch.

* * * * *